US008235476B2

(12) United States Patent
Desgranges

(10) Patent No.: US 8,235,476 B2
(45) Date of Patent: Aug. 7, 2012

(54) CLOSET TOP ACCESS BOX

(75) Inventor: Jean-Jacques Desgranges, Vanier (CA)

(73) Assignee: Jean-Jacques Desgranges, Ottawa Ontario (CA)

( * ) Notice: Subject to any disclaimer, the term of this patent is extended or adjusted under 35 U.S.C. 154(b) by 598 days.

(21) Appl. No.: 12/367,850

(22) Filed: Feb. 9, 2009

(65) Prior Publication Data

US 2009/0200904 A1 Aug. 13, 2009

Related U.S. Application Data

(60) Provisional application No. 61/028,084, filed on Feb. 12, 2008.

(51) Int. Cl.
*A47B 67/00* (2006.01)

(52) U.S. Cl. ..... 312/242; 312/245

(58) Field of Classification Search ..... 312/107, 312/108, 111, 242, 245, 257.1, 263; 108/193, 108/180, 187, 184, 162, 176
See application file for complete search history.

(56) References Cited

U.S. PATENT DOCUMENTS

| | | | | | |
|---|---|---|---|---|---|
| 119,289 | A * | 9/1871 | Whittemore | 312/4 |
| 1,476,785 | A * | 12/1923 | White | 52/36.4 |
| 1,736,007 | A * | 11/1929 | Johnston | 312/305 |
| 1,838,469 | A * | 12/1931 | Treiber | 52/205 |
| 2,012,803 | A * | 8/1935 | Baker | 312/263 |
| 2,790,209 | A * | 4/1957 | Thompson | 52/205 |
| 3,171,140 | A * | 3/1965 | Gutner | 5/296 |
| 3,347,187 | A * | 10/1967 | Khoury | 108/152 |
| 3,425,763 | A * | 2/1969 | De Lynn | 312/258 |
| 3,702,521 | A * | 11/1972 | Peterson | 160/19 |
| 3,729,113 | A * | 4/1973 | Lopatka | 220/480 |
| 4,859,008 | A * | 8/1989 | Eyre et al. | 312/257.1 |
| 4,998,388 | A * | 3/1991 | Englehart | 52/36.1 |
| 5,201,120 | A * | 4/1993 | Patrick | 29/897.31 |
| 2005/0257437 | A1 * | 11/2005 | Juten et al. | 52/36.1 |

* cited by examiner

*Primary Examiner* — Janet M Wilkens
(74) *Attorney, Agent, or Firm* — Dennis A. Bennett; Gale W. Starkey

(57) ABSTRACT

In a closet with an upper shelf and a door opening defined laterally by two vertical door frame posts which extend to the ceiling, a box frame having a box frame opening and a box frame door system is installed between these posts and above the location of the door opening. The box frame is fastened either to the door frame posts or to the ceiling to provide an opening by which articles may be more readily placed on the upper shelf. The upper shelf within the closet may extend only for a portion of the depth of the closet leaving a gap between such shelf and the box frame thereby providing access to objects present on the shelf through such gap.

14 Claims, 6 Drawing Sheets

CLOSET TOP ACCESS BOX

FIELD OF THE INVENTION

This invention relates to a device to allow access to the upper part of closets for the purpose of easing storage therein. More particularly, it addresses a mode of manufacturing a closet to provide improved access to the upper region of the closet.

BACKGROUND TO THE INVENTION

Household closets have an important role to play in everyday living. Storage is a major issue for everyone. Closet space is at a premium not only for apartment owners, but also for persons living in houses.

Various proposals have been made to enhance the efficiency by which things can be stored in closets. This includes closet organizers, specialty hooks and hangers, types of closet rods, etc.

Notwithstanding the above initiatives, the prospects of using, more efficiently, the upper shelving provided in a closet have not been fully addressed. A deterrent in this respect is that space permitting for upper shelving in a closet is partially obstructed by the existence of the framing located above the door opening of a standard closet.

Most closets have a door opening with a top portion or lintel spanning the door opening. Above this lintel the space is typically closed-in, as by plasterboard. The consequence is that the amount of space available for access to upper shelves is limited by the presence of such a lintel. While it may be possible to envisage a closet opening that extends fully to the ceiling, such an arrangement would be generally not be considered attractive, practical or acceptable.

The present invention addresses the problem of providing improved access to the upper regions of a closet which has a door opening wherein such upper regions would otherwise be obstructed by a door opening lintel. Further, the invention allows the addition of one or more further accessible closet shelves if one so desires, beyond the normal shelf.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to the present invention in one aspect, a closet with an upper shelf and a door opening is defined laterally by two vertical door frame posts which extend to the ceiling, includes, between these posts and above the location of the door opening, a box frame having a box frame opening and a box frame door system. Preferably, the box frame is fastened to the door frame posts, although it may also be attached to the ceiling.

According to a preferred variant of the invention, the box frame is of limited depth, extending backwardly from the box frame opening into the closet for only a minor percentage of the depth of the closet; e.g., 10-15%. Where, as in North America, framing is typically carried-out with standard 2×4 lumber, the depth of the door frame that extends inwardly into the closet is preferably on the order of 4 inches but optionally 5 or 6 inches. Generally, this results in a box frame which has a depth that is 1/10 of its width or less.

The box frame system of the invention provides an opening by which articles may be more readily placed on the upper shelf. Preferably, the box frame opening extends upwardly and, optionally, virtually all the way to the ceiling, the access provided by the frame can be larger than the dimensions of the access pathway normally available for placing objects on an upper closet shelf when a standard door lintel is present.

When a frame of this design is used in conjunction with a closet containing an upper shelf that extends outwardly from the rear wall of the closet by only a portion of the depth of the closet, a gap exists which can prove advantageous. While it is permissible for the upper shelf to extend entirely for the depth of the closet, extending to the box frame and making the shelf accessible only through the box frame opening, it is preferable for the upper shelf to be of a dimension that leaves a gap between the front edge of the upper shelf and the rear edge of the box frame. This gap can provide access for small objects to be placed on the upper shelf without the use of the box frame opening. It can permit ambient light from outside the closet to enter and illuminate the lower portion of the closet, and this gap can provide access for lifting objects stored on the upper shelf in order to move them outwardly through the box frame. Because such a gap is present between the shelf and the box frame, overhanging objects stored on the upper shelf can be supported manually while being moved outwardly through the box frame opening.

While it is preferable that the upper shelf be aligned substantially with the level of the lower transverse portion of the box frame, it is permissible for the upper shelf to be located either above or below this height. The presence of a gap as described above is particularly convenient when the shelf is below the level of the bottom portion of the box frame. An object stored on the shelf can then be accessed through the gap in order to be lifted-up for removal through the box frame. A similar advantage arises when the shelf is above the level of the bottom portion of the box frame whereby an object can be advanced outwardly through the frame by being contacted manually through the gap.

The box frame may be fitted with doors to seal the closet and provide an aesthetic appearance. A single door can be provided, preferably hinged about a horizontal axis by means of a hinge system connected along the upper edge of the box frame. A pair of doors can be provided, each hinged about a respective vertical axis located along the two vertical sides of the box frame. Standard door hardware may be included for such a doors including a handle and a latch.

By relying on the presence of vertical posts defining the door opening, a generally typical component of any closet design, and the box frame of the invention may be securely positioned above the door opening. As such, the bottom horizontal piece of the box frame is available to serve as a lintel for the door opening.

The bottom horizontal piece of the box frame can be fitted with a track by which sliding doors may be suspended or by which the roller in bifold doors is guided. Or, the bottom horizontal piece of the box frame can simply serve to carry doorstop elements against which the top portion of one or more vertically hinged doors may close. In the event that the bottom piece of the box frame is used to carry the weight of one or more doors, this piece may be strengthened by an added piece that gives such bottom piece a "T"-shaped cross-section.

The closet access box frame system of the invention is best suited for installation at the time a house is being constructed. However, it can also be installed on a retrofit basis in established housing at which point the existing lintel would preferably be removed or otherwise remain and the closet access box frame installed above the said lintel.

The closet access box frame system of the invention can also be integrated into a closet door frame kit in which case the assembled kit can be inserted in an opening provide specifically for the assembled kit.

More particularly such a kit may be installed in a finished wall recess having a closet opening extending upwardly from a floor towards a ceiling, the closet opening being defined by a pair of vertical studs and serving to frame the entrance to a closet. The closet may include a closet shelf located in the upper portion of the wall recess. In such case the closet opening kit comprises:

1) two opposed vertical, framing side members dimensioned to run from the floor towards the ceiling within the opening of the wall recess, the side members being spaced apart by a width to allow the side members to be each respectively affixed to a respective vertical stud in the closet opening, 2) a transverse upper member that is coupled transversely between upper ends of the side members, 3) a lintel member that extends transversely between the side members beneath the transverse upper member at a height to receive a closet door, the lintel member together with the upper member and upper portions of the side members defining an upper closet access opening, and 4) an upper door or pair of doors carried by the open box for covering the upper closet access opening, whereby, with the closet opening kit installed in the closet opening of the wall recess and with the upper door means open, articles may be more readily placed on the closet shelf for storage within the closet.

The closet opening kit may include a closet door assembly carried by one or more of the side members, or by the lintel, for covering the closet opening. When the closet contains an upper shelf which extends outwardly from a rear wall of the closet by only a portion of the depth of the closet, it should preferably extend no further than the rear edge of the lintel member. Preferably, such upper shelf should extend outwardly from the rear wall of the closet to a point short of the rear edge of the lintel member to provide a gap between the front edge of the shelf and the rear edge of the lintel member sufficiently large to provides access to the shelf from beneath the lintel member. This will allow objects to be placed on the upper shelf without the use of the box frame opening.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
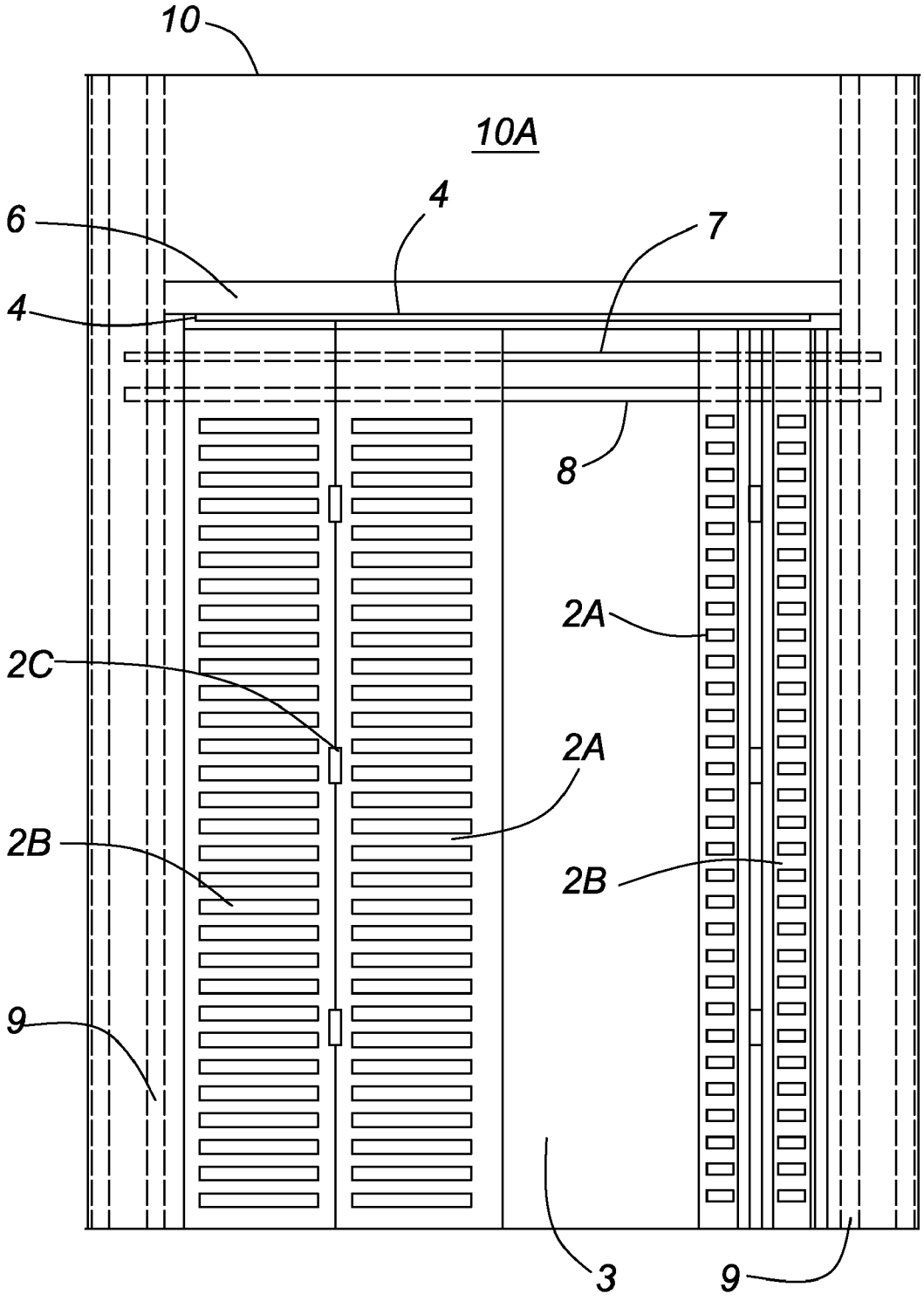
PRIOR ART FIG. 1
FIG. 1 is a front elevation view of a prior art closet having two closet doors bounded by side posts.

As shown in FIG. 1, a prior art closet is provided with folding closet doors, each having respective panels 2A, 2B fitted into a door opening 3. In this case, two hinged closet door panels 2A, 2B each hung at their top inside edges from a track 4 along the lintel 6 of the door opening 3 and are individually hinged to fold in two parts so that as depicted, one door may be closed while the other door may be opened. The closet door panels 2A, 2B are coupled to each other by hinges 2C and are guided by the roller guide track 4 at the top of the door opening 3.

Within the closet of FIG. 1 a typical shelf 7 is fitted against the back wall of the closet, extending for the full width of the closet interior but only part way out from the depths. The shelf 7 is in the upper region of the closet, positioned over the clothes hanging bar 8 also spanning the full width of the closet interior. The door opening 3 is defined laterally by two vertical doorframe posts 9 which extend to the height of the ceiling 10. The region 10A above the lintel 6 is normally closed-in with gypsum panel board.

Figure 2A:
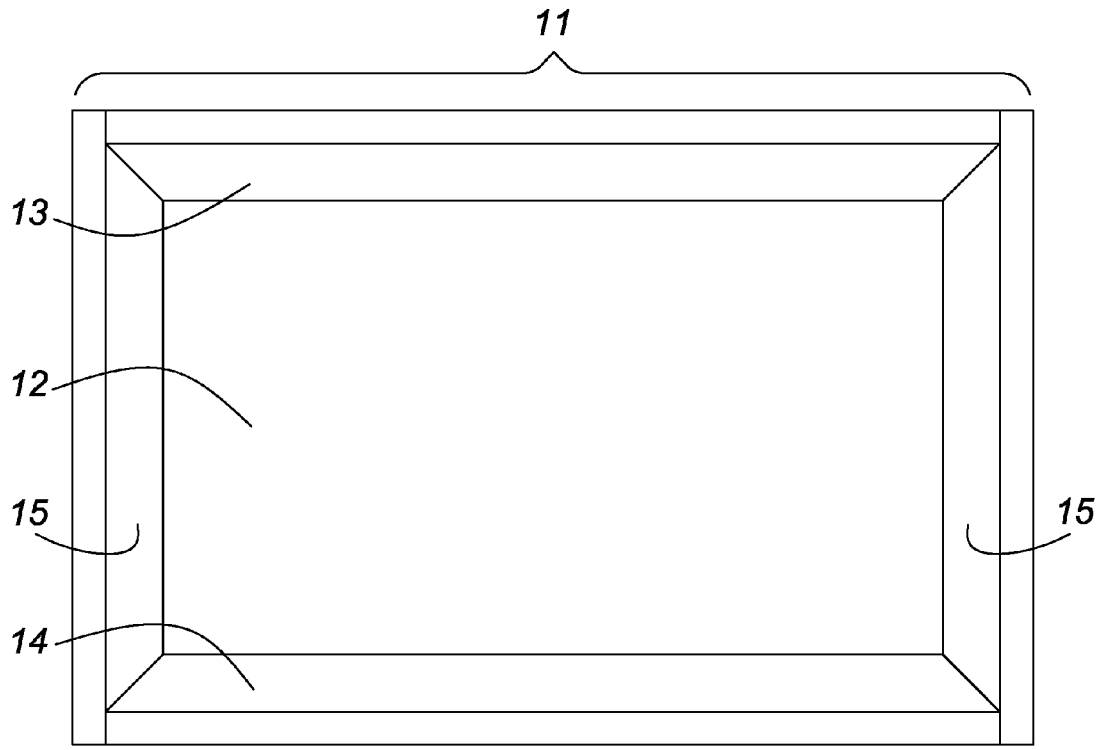
FIG. 2*a* is a front view of a box frame adapted for installation above the closed doors of FIG. 1.

In accordance with the invention and as shown in FIG. 2*a*, a box frame 11 having a box frame front opening 12, is defined by a top member 13, a bottom member 14, and two vertical side members 15. Not shown in FIG. 2, but shown in FIG. 6, a pair of doors 16A may be fitted to cover the opening 12. The box frame 11 is intended to be fastened to the doorframe posts 9 or ceiling. The box frame 11 may be fastened to the door frame posts 9 by spikes 17 or other similar fastening means 17, as shown in FIG. 3.

The box frame 11 is of limited depth, extending backwardly from the box frame front opening 12 into the closet for only a minor percentage of the depth of the closet, e.g. 10-15%. Where the framing used for the door frame posts 9 is effected with lumber of a specific width, the depth of the bottom member 14 of the box frame 11 may be of a similar width or slightly larger. Generally, this results in a box frame which has a depth which is 1/10 of its width or less.

Figure 2B:
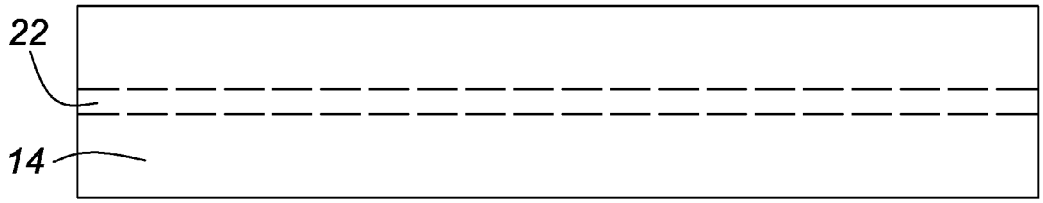
FIG. 2*b* is a bottom view of the box frame of FIG. 2 wherein the bottom portion of the frame is provided with a stiffener to form a "T" cross-section.

In the top view, FIG. 2*b*, the bottom portion 14 of the frame 11 is provided with a stiffener 22 which, in combination with the bottom portion 14 provides a "T" cross-section.

Figure 3:
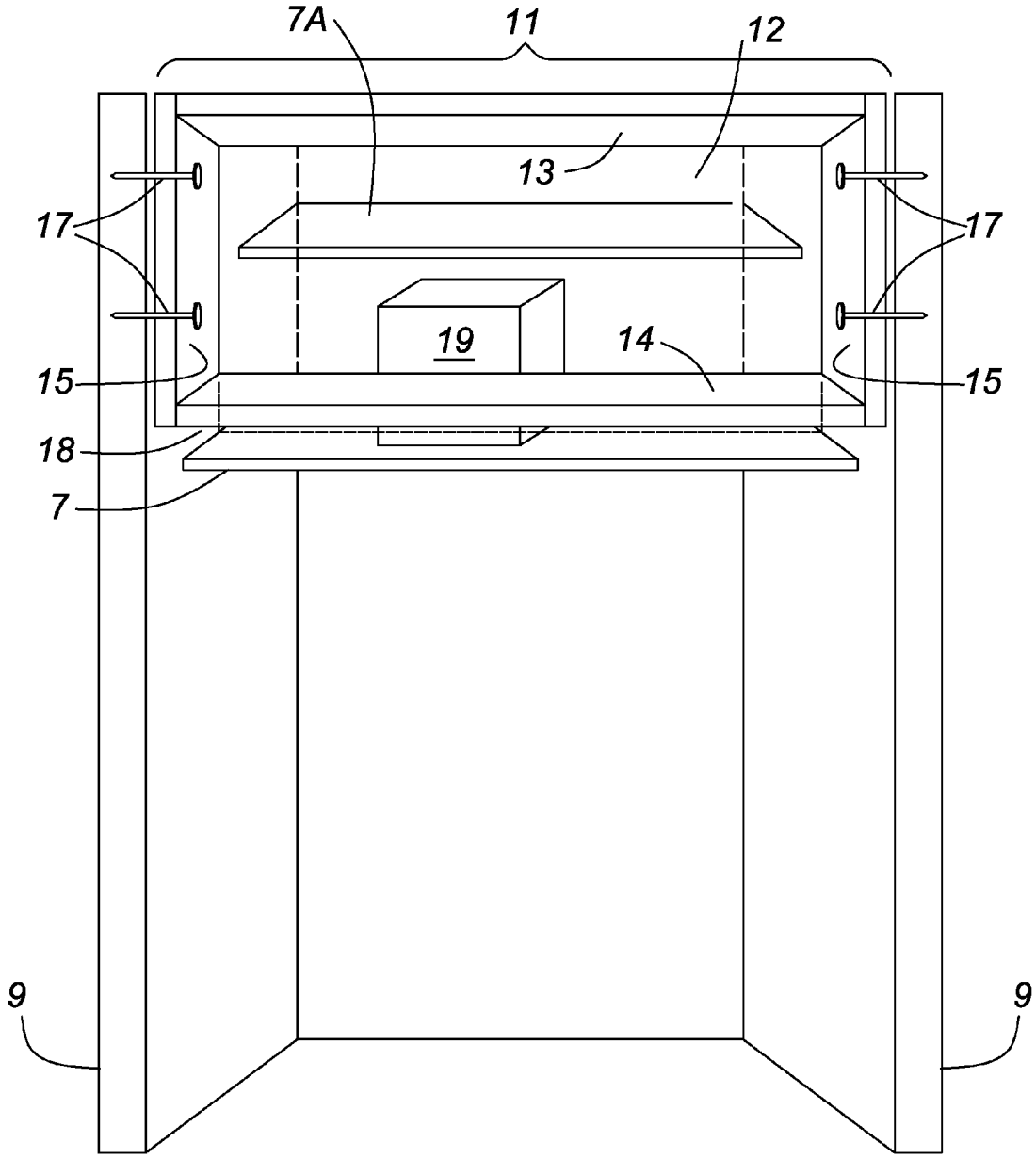
FIG. 3 is a front perspective view of the box frame as in FIG. 1 mounted above a shelf-containing closet opening with the closet doors removed.

As shown in FIG. 3, the box frame system of the invention provides an opening 12 by which articles may be more readily placed on one or more shelf(s) 7, 7A within the closet. As the shelf 7 extends forwardly from the rear wall of the closet by only a portion of the depth of the closet, a gap 18 shown in FIG. 3 is present between the front edge of the upper shelf 7 and the rear edge of the bottom member 14 of the box frame 11. This gap 18 can provide access for small objects to be placed on the upper shelf without the use of the box frame opening 12. This gap 18 can also permit ambient light from outside the closet to enter and illuminate the lower portion of the closet. And this gap 18 can provide access for lifting objects 19 stored on the upper shelf 7, and particularly when such objects 19 are overhanging the shelf 7, in order to move them outwardly through the box frame opening 12.

While it is preferable that the upper shelf 7 be aligned substantially with the level of the bottom member 14 of the box frame 11, it is permissible for the upper shelf 7 to be located either above or below this height. Although one lower shelf 7 and one upper shelf 7A are shown, several may be provided, including shelves at various heights.

Figure 4:
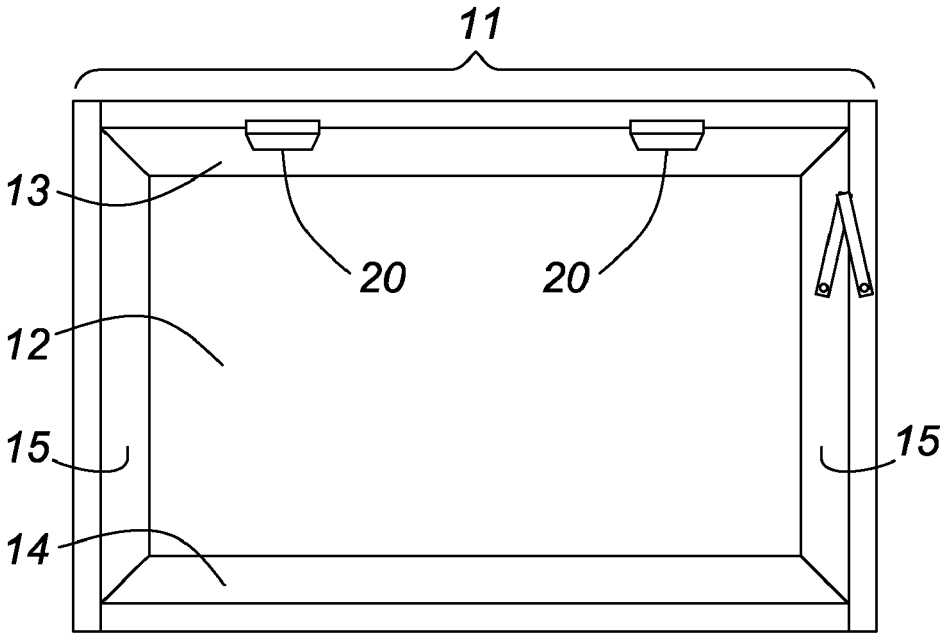
FIG. 4 is a front perspective view of the frame of FIG. 1 showing hardware.
Figure 5:
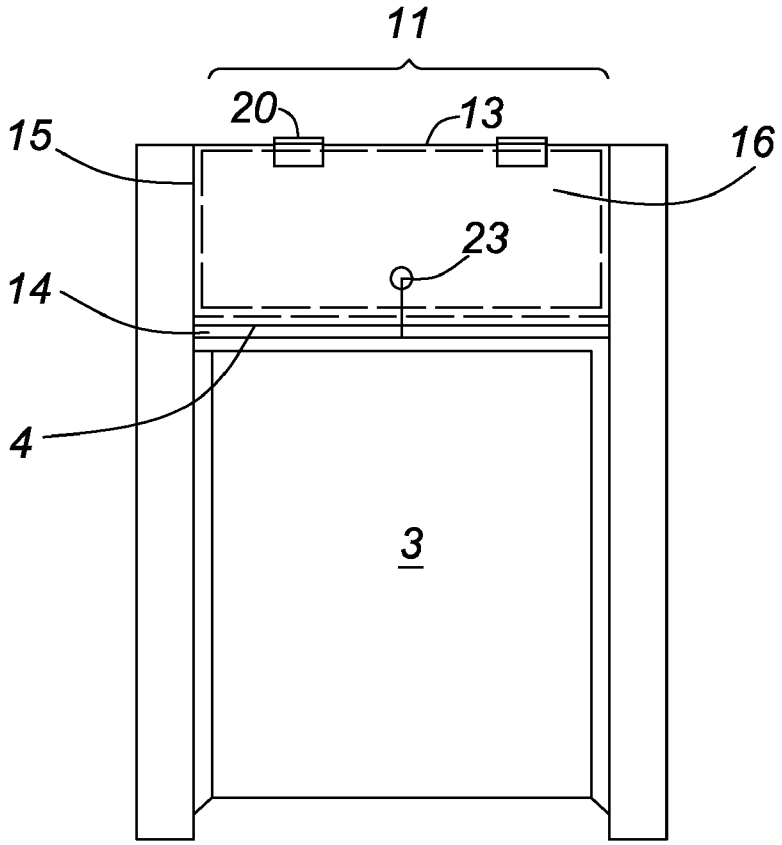
FIG. 5 is a front plan view of a typical installation of the frame of FIG. 2*a* installed in a typical closet wherein the frame is fitted with a single frame door.
Figure 6:
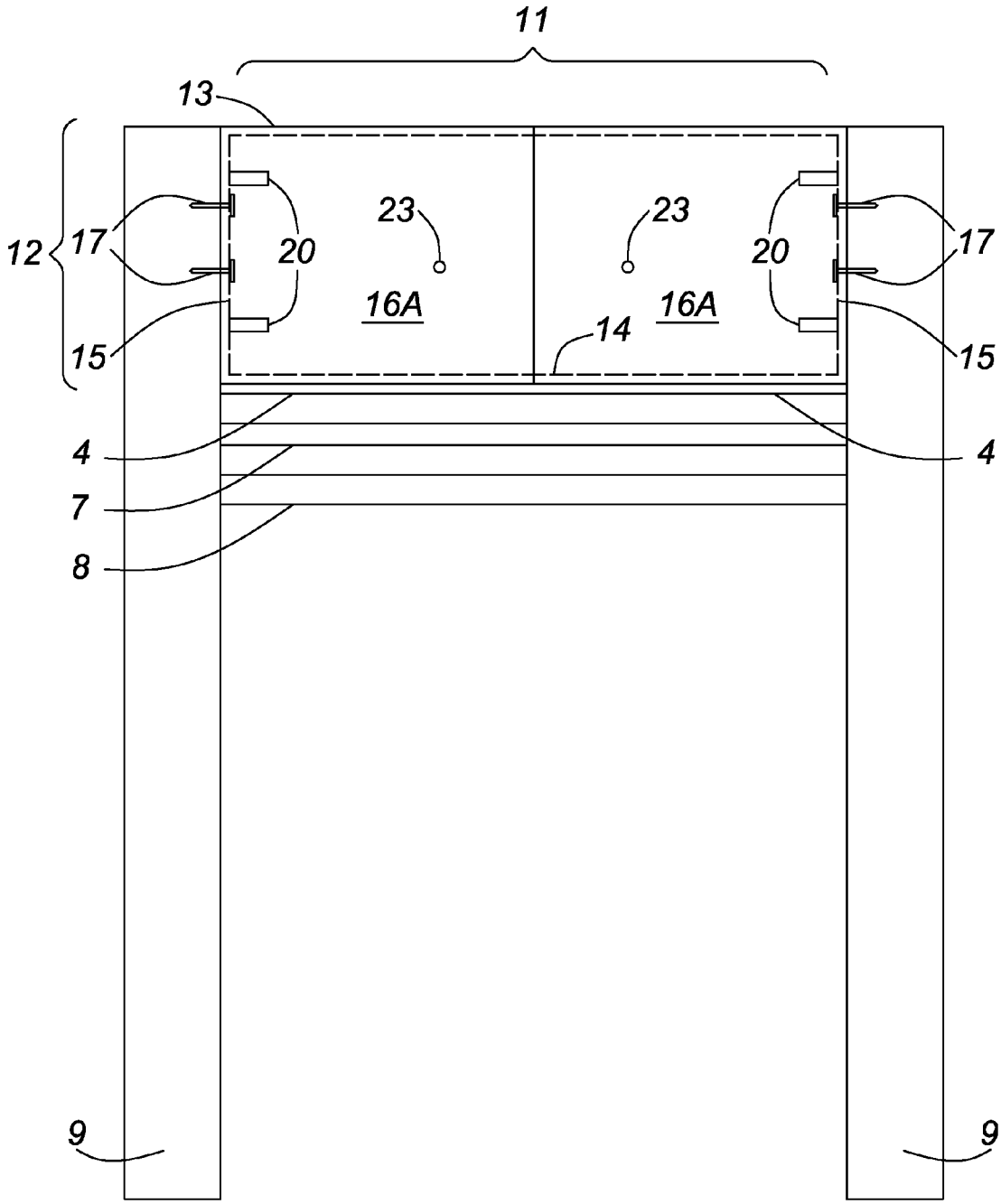
FIG. 6 is a front plan view of a typical installation of the frame of FIG. 2*a* installed in a typical closet wherein the frame is fitted with two frame doors.

The box frame may be fitted with one or more doors to seal the closet and provide an aesthetic appearance. A single door 16, as shown in FIG. 5, can be provided, hinged about a horizontal axis by means of hinges 20 connected along the top member 13 of the box frame 11, as shown in FIGS. 4 and 5. A pair of doors 16A can be provided as shown in FIG. 6, each hinged by hinges 20 about a respective vertical axis located along the two vertical sides members 15 of the box frame 11. Standard door hardware may be included for such a doors including hinges, a handle 23 and a latch (not shown).

By relying on the presence of vertical posts 9 defining the door opening 3, a typical component of any closet design, the box frame 11 of the invention may be securely positioned above the door opening 3 as shown in FIG. 5. As such, the bottom horizontal member 14 of the box frame 11 is available to serve as a lintel for the door opening 3.

The bottom horizontal piece 14 of the box frame 11 can be fitted with a track 4 by which closet door panels 2A, 2B may be suspended. In the event that the bottom member 14 of the box frame 11 is used to carry the weight of one or more doors to, this piece may be strengthened by an added piece 22 that gives such bottom piece 14 a "T"-shaped cross-section, as shown in FIG. 2*b*.

The frame doors 16 and 16A, as shown in FIGS. 5 and 6 respectively, can also optionally extend downwardly in order to screen the track 4 from optical view, while the clothes hanging bar 8 and shelf 7 remain visible. Where a single upwardly opening door 16 is installed on the box frame 11, anti-shutting hardware 20 as known in the prior art such as a hinged brace, shown in FIG. 4, may be installed.

The box frame 11 parts may be pre-cut to standard closet sizes or otherwise cut from custom measurements and once assembled with included hardware, will be fitted in the closet opening 3, which may have the gypsum wallboard covering the sideposts 9.

Figure 7:
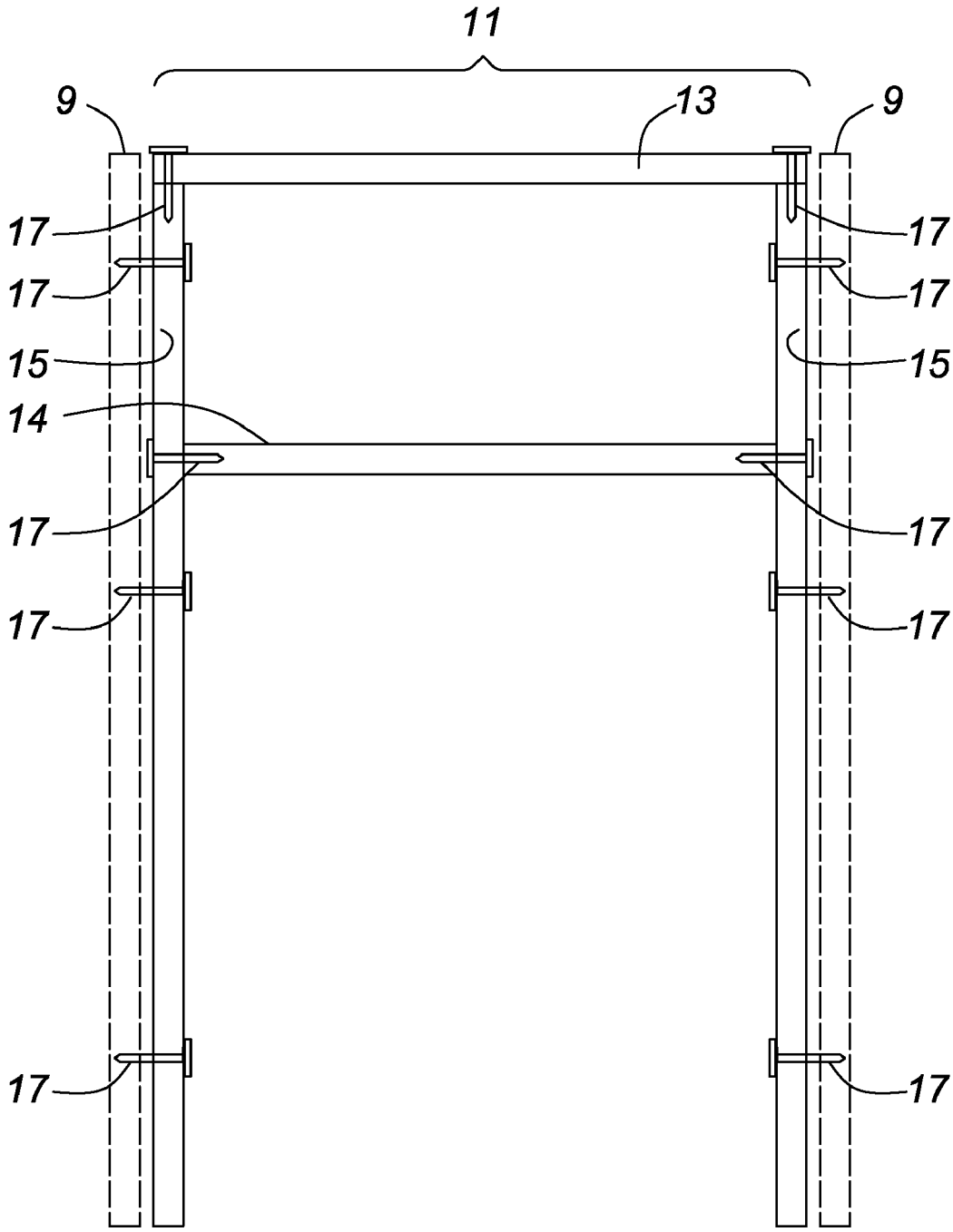
FIG. 7 is a front plan view of a variant of the invention which incorporates the closet access box into a closet door kit.

A box frame 11 may be incorporated into a closet opening kit as shown in FIG. 7. Such kit is intended to be installed in a finished wall recess having a closet opening extending upwardly from a floor towards a ceiling. The closet opening is normally defined by a pair of vertical studs 9 serving to frame the entrance to the closet. The closet typically includes a closet shelf 7 located in the upper portion of the wall recess as shown in FIGS. 1, 3 and 6. In such case the closet opening kit comprises:

1) two opposed vertical, framing side members 15 dimensioned to run from the floor towards the ceiling within the opening of the wall recess, the side members 15 being spaced apart by a width to allow the side members to be each respectively affixed to a respective vertical stud 9 in the closet opening, 2) a transverse upper member 13 that is coupled transversely between upper ends of the side members 15, 3) a lintel member 14 that extends transversely between the side members 15 beneath the transverse upper member 13 at a height to receive a closet door, the lintel member 14 together with the upper member 13 and upper portions of the side members 15 defining an upper closet access opening, and 4) an upper door or pair of doors (or more) as shown in FIG. 6 may be fitted to cover the integrated box frame 11.

With the closet opening kit installed in the closet opening of the wall recess and with the upper door or doors open, articles may be more readily placed on the closet shelf 14 for storage within the closet.

The closet opening kit may include a closet door assembly, e.g. such as doors 2B as shown in FIG. 1, carried by one or more of the side members 15, or by the lintel 14, for covering the closet opening.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

I claim:

1. A box frame installed beneath a ceiling in a closet with an upper shelf and a door opening defined laterally by two vertical door frame posts which extend to the ceiling, the box frame having a box frame opening, side members, a top member, a bottom member and a box frame door system all to be installed between these posts and above the location of the door opening, the box frame for being fastened either to the door frame posts or to the ceiling to provide an opening by which articles may be more readily placed on the upper shelf wherein the upper shelf extends outwardly from a rear wall of the closet by only a portion of the depth of the closet to provide a gap between the front edge of the shelf and a rear edge of the bottom member of the box frame.

2. The box frame as in claim 1 wherein the box frame is of limited depth, the box frame having a depth which is 1/10 of its width or less whereby the box frame will be able to extend backwardly from the front of the box frame opening into the closet for only a minor percentage of the depth of the closet.

3. The box frame as in claim 1 in combination with the closet having a depth wherein the box frame extends backwardly from the front of the box frame opening by an amount which represents between 10 to 15 percent of the depth of the closet.

4. The box frame as in claim 1 wherein the shelf is positioned below the level of the bottom member of the box frame.

5. The box frame as in claim 1 wherein the shelf is positioned above the level of the bottom member of the box frame.

6. The box frame as in claim 1 wherein the shelf is positioned at the level of the bottom member of the box frame.

7. The box frame as in claim 1 comprising a single door hinged about a horizontal axis by means of a hinge system connected along the upper edge of the box frame.

8. The box frame as in claim 1 comprising a pair of doors, each being respectively hinged about a respective vertical axis located along the two vertical side members of the box frame.

9. The box frame as in claim 1 in combination with the closet having the door opening wherein the bottom member of the box frame serves as a lintel for the door opening.

10. The box frame as in claim 9 wherein the bottom member of the box frame is strengthened by an added piece that gives such bottom member a "T"-shaped cross-section.

11. The box frame as in claim 1 wherein the bottom member of the box frame is fitted with a track in combination with sliding closet doors suspended from such track.

12. A closet opening kit installed in a wall recess having a closet opening extending upwardly from a floor towards a ceiling, the closet opening being defined by a pair of vertical studs and serving to frame the entrance to a closet wherein the closet includes a closet shelf located in the upper portion of the wall recess, the closet opening kit comprising:

two opposed vertical, framing side members dimensioned to run from the floor towards the ceiling within the opening of the wall recess, the side members being spaced apart by a width to allow the side members to be each respectively affixed to a respective vertical stud in the closet opening;

a transverse upper member that is coupled transversely between upper ends of the side members;

a lintel member that extends transversely between the side members beneath the transverse upper member at a height to receive a closet door, the lintel member together with the upper member and upper portions of the side members form a frame defining an upper closet access opening;

and an upper door or pair of doors carried by the frame for covering the upper closet access opening;

whereby, with the closet opening kit installed in the closet opening of the wall recess and with the upper door open, articles may be more readily placed on the closet shelf for storage within the closet the closet shelf extends outwardly from a rear wall of the closet by only a portion of the depth of the closet and no further than a rear edge of the lintel member.

13. A closet opening kit as in claim 12 wherein the upper shelf extends outwardly from the rear wall of the closet to a point short of the rear edge of the lintel member to provide a gap between the front edge of the shelf and the rear edge of the lintel member that provides access to the shelf from beneath the lintel member.

14. A closet opening kit as in claim 12 wherein the gap is of a dimension to provide access to objects placed on the upper shelf without the use of the box frame opening.

* * * * *